US006129642A

United States Patent [19]

DonTigny

[11] Patent Number: 6,129,642

[45] Date of Patent: Oct. 10, 2000

[54] ARROW SHAFT WITH AN AERODYNAMIC GROOVE

[76] Inventor: Richard Louis DonTigny, 66 15th St., West, Havre, Mont. 59501

[21] Appl. No.: 09/228,516

[22] Filed: Jan. 11, 1999

[51] Int. Cl.[7] ..... F42B 6/04

[52] U.S. Cl. ..... 473/578

[58] Field of Search ..... 473/578, FOR 216

[56] References Cited

U.S. PATENT DOCUMENTS

| | | | |
|---|---|---|---|
| 3,968,784 | 7/1976 | Miller | 473/578 X |
| 4,182,513 | 1/1980 | Henderson | 473/586 |
| 5,273,293 | 12/1993 | Lekavich | 473/578 |

FOREIGN PATENT DOCUMENTS

| | | | |
|---|---|---|---|
| 1043352 | 11/1953 | France | 473/FOR 216 |

OTHER PUBLICATIONS

Advertisement for "X–CALIBER" Arrow Shaft, Bow & Arrow Hunting Magazine, Apr. 1985, p. 13.

*Primary Examiner*—John A. Ricci

[57] ABSTRACT

An improved arrrow shaft is modified to include an aerodynamic groove longitudinally placed on the bottom of the shaft to improve accuracy, flatten trajectory and increase the flight distance of the arrow. The aerodynamics of the improved arrow shaft improve the flight characteristics of conventional fletched arrows and allow the use of fletchless arrows in combination with an archery bow or a crossbow.

1 Claim, 1 Drawing Sheet

ARROW SHAFT WITH AN AERODYNAMIC GROOVE

BACKGROUND OF INVENTION

1. Field of the Invention

The present invention relates to the design of arrow shafts such as used in the field of archery. All such arrow shafts are round and straight, have points of various types, nocks and fletching. Points are essentially for penetration either into targets or game. The nock of the arrow functions to engage the bow string until the arrow is loosed. The flight characteristics of the arrow depend primarily on the fletching, either made from feathers or plastic. The fletching causes a measurable drag on the arrow and may also become partially or wholly torn from the shaft of the arrow during use, further impairing the aerodynamics of the flight of the arrow, necessitating the repair or replacement of the fletching. Fletching usually consists of three vanes, each attached to the rear of the arrow shaft at about 120° from the others so that when the bow string is in the nock, one vane is horizontal at 90° to the nock and the other two vanes are about 30° from vertical. This necessary placement of the vanes has an inherent slightly detrimental effect on aerodynamics. It would be advantageous to modify the shape of the shaft to improve the aerodynamics and accuracy for the conventional arrow with fletching or to eliminate the necessity for fletching.

2. Description of the Prior Art

The basic arrow consists of point, shaft, fletching and nock. The points have been made from bone, flint, and metal and vary in shape, depending upon their use at targets, fish or various game. Nocks were simply carved into the shaft of the arrow, but are now predominately plastic and replaceable. One such nock (U.S. Pat. No. 5,306,019 to Guest and Eckert) is adjustable and holds the bow string within the nock until release. Fletching is usually made from feathers, such as turkey, or plastic. Shafts have been made from reed, wood dowels, carbon fiber and metal tubes and have always been round and straight. Aerodynamics of the shaft have been improved through the addition of an airfoil structure on top of the shaft (U.S. Pat. No. 4,182,513 to Henderson).

There is a need for a more aerodynamic arrow shaft that will provide increased range, a flatter trajectory, improve accuracy and eliminate the need for fletching or airfoil structures.

SUMMARY OF THE INVENTION

The present invention is a more efficacious arrow shaft with an ease and simplicity of manufacture. More particularly the invention is concerned with an aerodynamic groove on the bottom of the shaft of the arrow to allow the shaft to capture air to fly further and more accurately. Much as the groove on the bottom of a snow ski helps it to track in a straight line, the groove on the bottom of the arrow shaft has a stabilizing action that helps the arrow to fly straight. This aerodynamic groove improves the flight characteristics of a conventional arrow with fletching and can eliminate the need for fletching or airfoil structures.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In order that the invention may be clearly understood and readily carried into effect, preferred embodiments will now be described by way of example only with reference to the accompanying drawings wherein.

DESCRIPTION OF THE PREFERRED EMBODIMENTS

Figure 1:
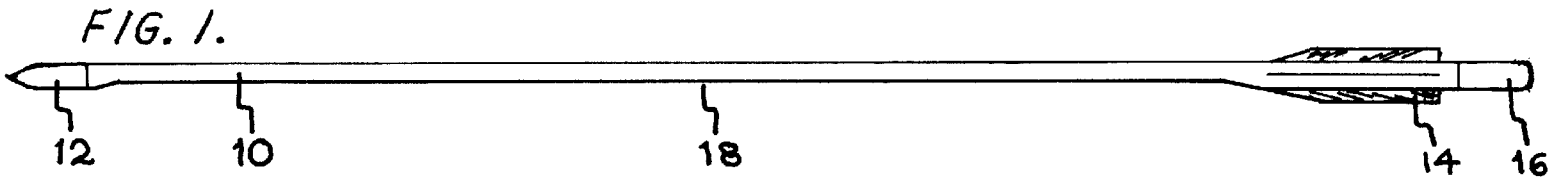
FIG. 1 is a side view of a fletched arrow with the aerodynamic groove longitudinally on the bottom of the shaft.

Prior to explaining the invention in detail, it is to be understood that the invention is not limited in its application to the details of construction and the arrangements of the components set forth in the following descriptions or illustrated in the drawings. The invention is capable of other embodiments and of being practiced and carried out in various ways. Also, it is to be understood that the phraseology and terminology employed herein is for the purposes of description and should not be regarded as limiting.

Figure 2:
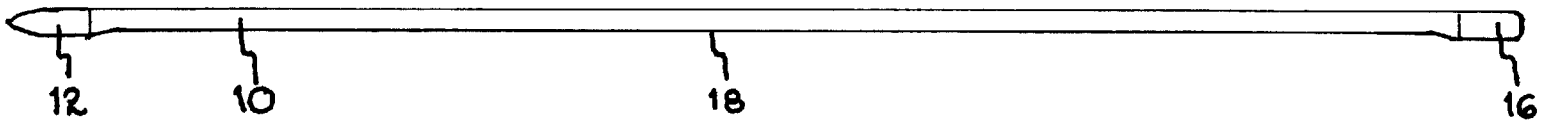
FIG. 2 is a side view of a fletchless arrow with the aerodynamic groove longitudinally on the bottom of the shaft.
Figure 3:
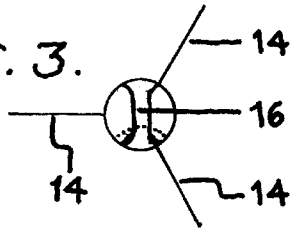
FIG. 3 is a view of the nock end of a fletched arrow.
Figure 4:
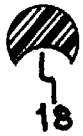
FIG. 4 is a cross section of a solid shaft.
Figure 5:
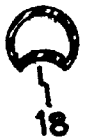
FIG. 5 is a cross section of a tubular shaft.
Figure 6:
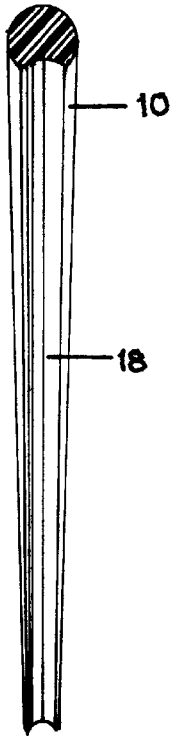
FIG. 6 is a perspective view of the bottom of the grooved shaft.

FIG. 1 illustrates an arrow shaft (10) with point (12), fletching (14) and nock (16). The aerodynamic groove (18) is on the bottom of the shaft. FIG. 2 illustrates a longer groove on a fletchless arrow shaft. FIG. 3 illustrates the vertical nock orientation of a normally fletched arrow as it would engage the string of a vertically held bow. The orientation of the elongated aerodynamic groove is shown by the dotted line. FIG. 4 illustrates the location and configuration of the preferred embodiment of the aerodynamic groove in a solid cross section and FIG. 5 illustrates this configuration in a tubular cross section. FIG. 6 is a perspective view of the preferred embodiment of the longitudinally located aerodynamic groove on the bottom of the arrow shaft.

Although this invention has been described in detail with particular reference to the preferred embodiments thereof, it will be understood that variations and modifications can be effected within the spirit and scope of the invention as described and defined in the appended claims.

I claim:

1. An improved arrow shaft, for use with fletched or fletchless arrows, and adapted to be launched generally horizontally using an archery bow or crossbow, said improved arrow shaft having only one elongated aerodynamic groove, said groove longitudinally extending along at least a portion of said arrow shaft, and located on the bottom of the shaft when the shaft is in a horizontal position to be launched.

* * * * *